US007648589B2

(12) United States Patent
Taya et al.

(10) Patent No.: US 7,648,589 B2
(45) Date of Patent: Jan. 19, 2010

(54) ENERGY ABSORBENT MATERIAL

(75) Inventors: Minoru Taya, Mercer Island, WA (US); Ying Zhao, Seattle, WA (US)

(73) Assignee: University of Washington, Seattle, WA (US)

( * ) Notice: Subject to any disclaimer, the term of this patent is extended or adjusted under 35 U.S.C. 154(b) by 189 days.

(21) Appl. No.: 11/222,023

(22) Filed: Sep. 8, 2005

(65) Prior Publication Data

US 2008/0020229 A1 Jan. 24, 2008

Related U.S. Application Data

(60) Provisional application No. 60/608,395, filed on Sep. 8, 2004.

(51) Int. Cl.
*C22F 1/00* (2006.01)

(52) U.S. Cl. ..... 148/402; 419/2; 419/56; 267/136; 267/182; 52/167; 428/613

(58) Field of Classification Search ..... 419/2; 148/402
See application file for complete search history.

(56) References Cited

U.S. PATENT DOCUMENTS

| | | | | |
|---|---|---|---|---|
| 2,494,235 | A | 1/1950 | Gierwiatowski | 250/40 |
| 3,096,449 | A | 7/1963 | Stucki | 307/88.5 |
| 3,517,193 | A | 6/1970 | Mook, Jr. et al. | 250/83.1 |
| 3,942,759 | A | 3/1976 | Passera, deceased et al. | 251/129 |
| 4,945,727 | A * | 8/1990 | Whitehead et al. | 60/527 |
| 5,071,064 | A | 12/1991 | AbuJudom et al. | 236/1 G |
| 5,080,205 | A | 1/1992 | Miller et al. | 188/299 |
| 5,475,353 | A | 12/1995 | Roshen et al. | 335/78 |
| 5,687,958 | A * | 11/1997 | Renz et al. | 267/136 |
| 5,750,272 | A * | 5/1998 | Jardine | 428/686 |
| 6,065,934 | A | 5/2000 | Jacot et al. | 416/155 |
| 6,326,707 | B1 | 12/2001 | Gummin et al. | 310/12 |
| 6,427,712 | B1 | 8/2002 | Ashurst | 60/527 |

(Continued)

FOREIGN PATENT DOCUMENTS

| | | |
|---|---|---|
| EP | 0 997 953 | 3/2000 |

(Continued)

OTHER PUBLICATIONS

Darel E. Hodgson and Robert J. Biermann, "Shape Memory Alloys," ASM Handbook, vol. 2, pp. 897-902, 1992.*

(Continued)

*Primary Examiner*—Roy King
*Assistant Examiner*—Christopher Kessler
(74) *Attorney, Agent, or Firm*—Ronald M. Anderson

(57) ABSTRACT

A method for making a ductile and porous shape memory alloy (SMA) using spark plasma sintering, and an energy absorbing structure including a ductile and porous SMA are disclosed. In an exemplary structure, an SMA spring encompasses a generally cylindrical energy absorbing material. The function of the SMA spring is to resist the bulging of the cylinder under large compressive loading, thereby increasing a buckling load that the cylindrical energy absorbing material can accommodate. The SMA spring also contributes to the resistance of the energy absorbing structure to an initial compressive loading. Preferably, the cylinder is formed of ductile, porous and super elastic SMA. A working prototype includes a NiTi spring, and a porous NiTi cylinder or rod.

12 Claims, 8 Drawing Sheets

U.S. PATENT DOCUMENTS

| | | | | |
|---|---|---|---|---|
| 6,457,654 | B1 | 10/2002 | Glezer et al. | 239/4 |
| 6,499,952 | B1 | 12/2002 | Jacot et al. | 60/527 |
| 6,530,564 | B1 * | 3/2003 | Julien | 267/147 |
| 6,563,933 | B1 | 5/2003 | Niederdraenk | 381/417 |
| 6,609,698 | B1 | 8/2003 | Parsons et al. | 251/129.17 |
| 6,633,095 | B1 | 10/2003 | Swoope et al. | 310/12 |
| 6,705,323 | B1 * | 3/2004 | Nikolchev et al. | 128/830 |
| 6,796,124 | B2 | 9/2004 | Kutlucinar | 60/528 |
| 6,832,477 | B2 | 12/2004 | Gummin et al. | 60/527 |
| 7,246,489 | B2 | 7/2007 | Du Plessis et al. | 60/528 |
| 2003/0202048 | A1 | 10/2003 | Silverbrook | 347/54 |
| 2003/0206490 | A1 | 11/2003 | Butler et al. | 367/163 |
| 2005/0016642 | A1 | 1/2005 | Oikawa et al. | 148/563 |
| 2005/0263359 | A1 | 12/2005 | Mankame et al. | 188/266.1 |
| 2006/0186706 | A1 | 8/2006 | Browne et al. | 296/203.01 |

FOREIGN PATENT DOCUMENTS

| | | | |
|---|---|---|---|
| JP | 62-88890 | | 4/1987 |
| JP | 63169367 | A * | 7/1988 |
| JP | 2002-129273 | | 5/2002 |
| JP | 2002-285269 | | 10/2002 |

OTHER PUBLICATIONS

Suorsa Ilkka. "Performance and Modeling of Magnetic Shape Memory Actuators and Sensors." *Department of Electrical and Communications Engineering Laboratory of Electromechanics.* Helsinki University of Technology, 70pp.

Suorsa, Ilkka. "*Performance and Modeling of Magnetic Shape Memory Actuators and Sensors*." 3pp. <http://lib.tkk.fi/Diss/2005/isbn9512276453/>.

Gorman, Jessica. "*Fracture Protection: Nanotubes toughen up ceramics." Science News Online.* Week of Jan. 4, 2003: vol. 163, No. 1, p. 3.

Lagoudas, Dimitris. "*Dynamic Behavior and Shock Absorption Properties of Porous Shape Memory Alloys." Storming Media.* A577304: Jul. 8, 2002. 3pp.

Lagoudas, Dimitris. "*Pseudoelastic SMA Spring Elements for Passive Vibration Isolation: Part I—Modeling." Storming Media.* A639824: Jun. 2004. 3pp.

Lagoudas, Dimitris C., and Eric L. Vandygriff. "*Processing and Characterization of NiTi Porous SMA by Elevated Pressure Sintering." Center for Mechanics and Composites.* Aerospace Engineering Department, Texas A&M University, 22pp.

Liang, Yuanchang; Taya, M.; Kuga, Yasuo. "*Design of membrane actuators based on ferromagnetic shape memory allow composite for the synthetic jet actuator." Smart Structures and Materials 2004.* Proc. of SPIE vol. 5390 pp. 268-275.

Liang, Yuanchange; Taya, M.; Kuga, Yasuo. "*Design of diaphram actuator based on ferromagnetic shape memory alloy composite." Smart Structures and Materials 2003.* Proc. of SPIE vol. 5054 pp. 45-52.

Matsunaga, Yasuhiro et al. "*Design of ferromagnetic shape memory alloy composites based on TiNi for robust and fast actuators*." 2002. *Proc. SPIE on Smart Materials.* Mar. 17-21, 2002: 4699:172. 10pp.

Wada, Taishi and Taya, Minoru. "*Spring-based actuators." Smart Structures and Materials 2002:* Active Materials: Behavior and Mechanics, Christopher S. Lynch, Editor, Proceedings of SPIE vol. 4699 (2002). pp. 249-302.

Wu, Kevin E., and Breur, Kenneth S. "*Dynamics od Synthatic Jet Actuator Arrays FGor Flow Control." American Institute of Aeronautics and Astronautics. © 2003.* 8pp. Available at: <http://microfluids.engin.brown.edu/Breuer%20Group%20Papers.html>.

Ye, L.L., Liu, Z.G., Raviprasad, K., Quan, M.X., Umemoto, M., and Hu, Z.Q.. "*Consolidation of MA amorphous NiTi powders by spark plasma sintering." Materials Science and Engineering A241* (1998). pp. 290-293.

"*Fine Particle Industry Review,* 1998." *Business Communications Co.*. May 1999: 5pp.

Lagoudas, Dimitris C., and Eric L. Vandygriff. "Processing and Characterization of NiTi Porous SMA by Elevated Pressure Sintering" Center for Mechanics and Composites, Aerospace Engineering Department, Texas A&M University, College Station,TX 77843-3141.

Heczko, C., Alexei Sozinov, and Kari Ullakko. "Giant Field-Induced Reversible Strain in Magnetic Shape Memory NiMnGa Alloy" IEEE Transactions on Magnetics, vol. 36, No. 5, Sep. 2000, pp. 3266-3268.

Johnson, Todd. "A Concept for an Inexpensive Low Speed Rotary Actuator Utilizing Shape Memory Alloy Filaments" FERMILAB-VLHCPUB-134, Nov. 1998. 11pp.

Suorsa, I., Tellinen, J., Pagounis, E., Aaltio, I., and Ullakko, K. "Applications of Magnetic Shape Memory Actuators" Actuator 2002, Messe Bremen GMBH. Programme of Oral Sessions, Apr. 26, 2002.

Tellinen, J., Suorsa, I., Jääskeläinen, A., Aaltio, I., and Ullakko, K. "Basic Properties of Magnetic Shape Memory Actuators" Actuator 2002, Bremen, Germany, Jun. 10-12, 2002.

Ullakko, K. "Magnetically Controlled Shape Memory Alloys: A New Class of Actuator Materials" Journal of Materials Engineering and Performance, ASM International, Materials Park, OH. vol. 5, No. 3, Jun. 1, 1996; pp. 405-409.

Ullakko, K., J.K. Huang, C. Kantner, R.C. O'Handley, and V.V. Kokorin. "Large magnetic-field-induced strains in $Ni_2MnGa$ single crystals" Appl. Phys. Lett. 69 (13), Sep. 23, 1996, pp. 1966-1968.

Wada, Taishi, Ryan C.C. Lee, Simon H.H. Chen, Masahiro Kusaka, and Minoru Taya. "Design of spring actuators made of ferromagnetic shape memory alloy and composites" Smart Structures and Materials 2003: Industrial and Commercial Applications of Smart Structures Technologies, Eric H. Anderson, Editor, Proceedings of SPIE vol. 5054 (2003), pp. 125-134.

Song, Zhenlun et al. "Fabrication of closed cellular nickel alloy containing polymer by sintering method." Journal of Alloys and Compounds 355, pp. 166-170, 2003.

* cited by examiner

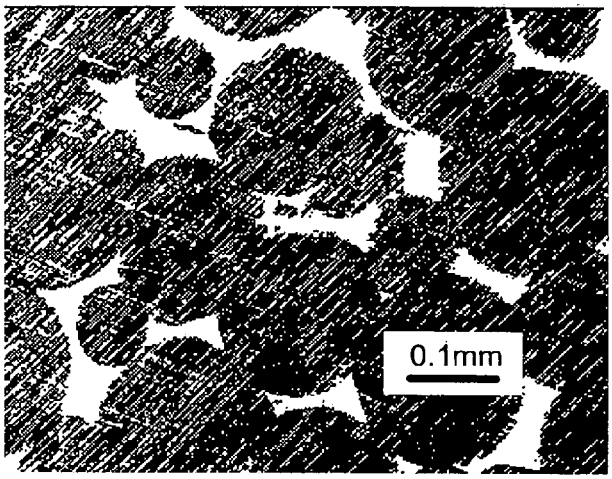
*FIG. 5A*
*FIG. 5B*
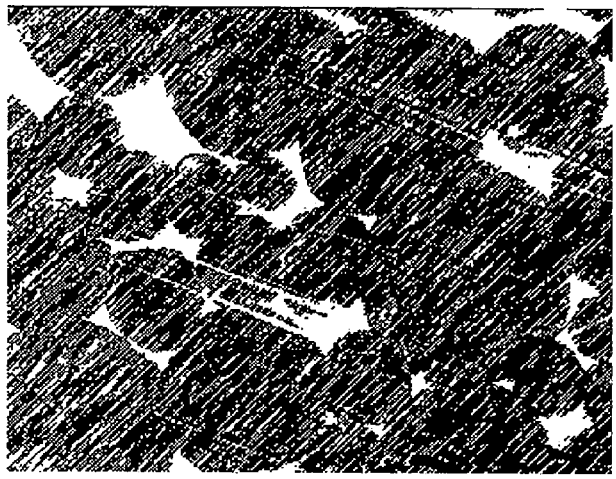
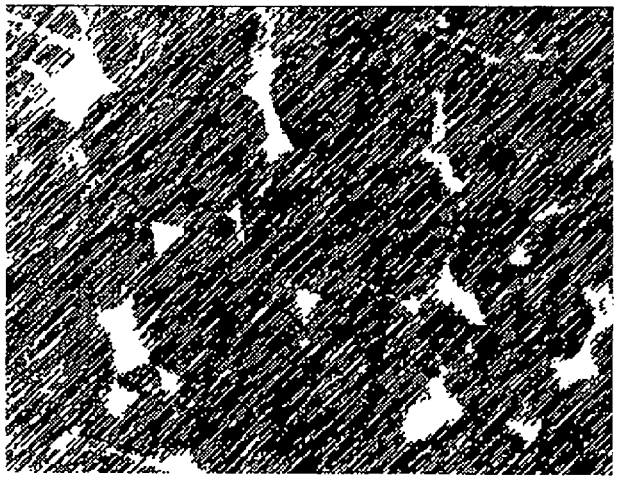
*FIG. 5C*

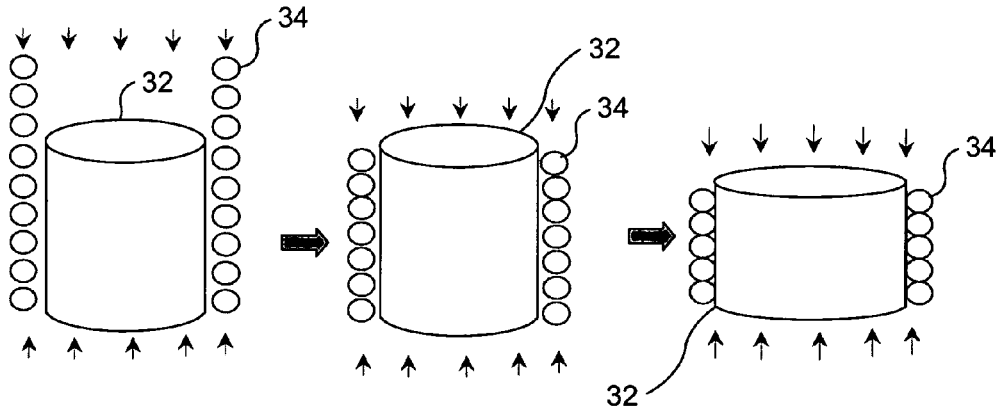
FIG. 8A FIG. 8B FIG. 8C
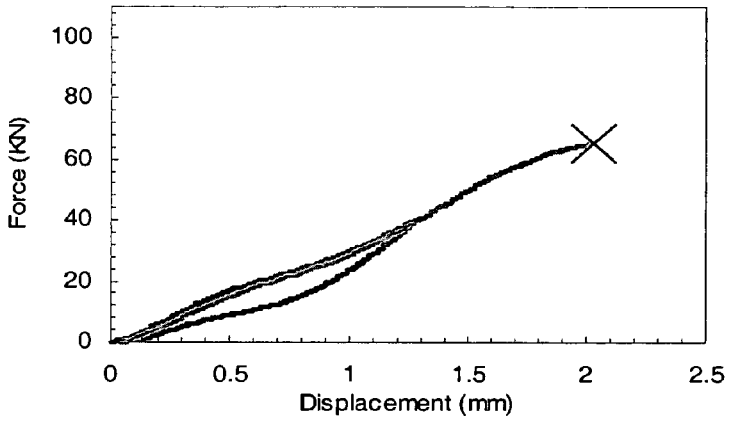
FIG. 9A
FIG. 9B
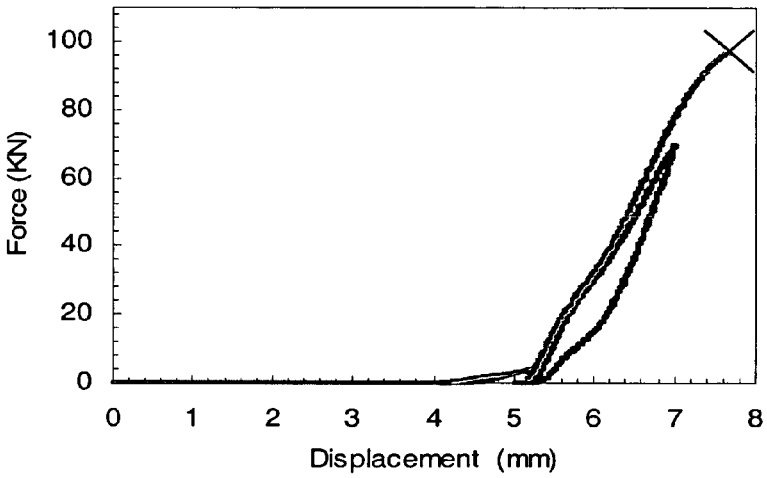

ENERGY ABSORBENT MATERIAL

RELATED APPLICATIONS

This application is based on a prior copending provisional application, Ser. No. 60/608,395, filed on Sep. 8, 2004, the benefit of the filing date of which is hereby claimed under 35 U.S.C. §119(e).

GOVERNMENT RIGHTS

This invention was funded at least in part with a grant (No. N-000140210666) from the ONR, and the U.S. government may have certain rights in this invention.

BACKGROUND

Over the last two decades, shape memory alloys (SMA) have attracted great interest as materials that could be beneficially employed in a wide variety of applications, including aerospace applications, naval applications, automotive applications, and medical applications. NiTi alloy is one of the more frequently used SMAs, due to its large flow stress and shape memory effect strain. Recently, porous NiTi has been considered for incorporation into medical implants, and as a high energy absorption structural material. While the properties of porous NiTi are intriguing, fabrication of porous NiTi is challenging. One prior art technique for fabricating porous NiTi is based on a combustion synthesis. However, studies have indicated porous NiTi synthesized by this method is brittle. Another fabrication method that has been investigated involves powder sintering; however, studies have indicated that porous NiTi fabricated using powder sintering is also brittle, and lacks a stress plateau in the stress-strain curve. A self-propagating high temperature synthesis (SHS) is a further technique that can be used to produce porous NiTi; yet again, the porous NiTi fabricated using SHS is undesirably brittle. Still another technique disclosed in the prior art employs a hot isostatic press (HIP), which also yields a brittle porous NiTi.

It would be desirable to provide techniques for fabricating porous NiTi that exhibits a higher ductility, i.e., which is not brittle. It would further be desirable to provide a new energy absorbing structure based on the properties of porous SMA, such as NiTi.

SUMMARY

In order to achieve a porous SMA exhibiting a higher ductility than available using prior art methods, a spark plasma sintering (SPS) method is disclosed herein. NiTi raw powders (preferably of super-elastic grade) are loaded into a graphite die and pressed to a desired pressure. A current is then induced through the die and stacked powder particles. The current activates the powder particles to a high energy state, and neck formation easily occurs at relatively low temperatures, in a relatively short period of time, as compared with conventional sintering techniques (such as hot press, HIP or SHS techniques). Moreover, the spark discharge purifies the surface of the powder particles, which enhances neck formation, and the generation of high quality sintered materials. Empirical studies have indicated that the SPS technique can achieve a porous NiTi exhibiting greater ductility than achievable using other methods disclosed in the prior art.

In at least one embodiment, the raw NiTi powder comprises 50.9% nickel and 49.1% titanium. While empirical studies have focused on using the SPS technique with NiTi powders, it should be understood that the SPS technique disclosed herein can also be used to achieve high quality SMA alloys made from other materials.

The disclosure provided herein is further directed to an energy absorbing structure including a porous and ductile SMA. The energy absorbing structure includes a super elastic grade SMA component, and a porous and ductile SMA portion. In at least one embodiment the porous and ductile SMA is NiTi. Significantly, the porosity of the porous and ductile SMA portion enables a relatively lightweight structure to be achieved, while the energy absorbing properties of the porous and ductile SMA portion enhance the energy absorbing capability of the structure.

Such an energy absorbing structure can be achieved by combining a (preferably super elastic) NiTi spring with a porous and ductile NiTi bar or rod, such that the spring and bar are coaxial, with the spring encompassing the bar. The spring acts as a constraint to increase the bar's ability to accommodate a buckling load. This arrangement enables the energy absorbing structure to exhibit a desirable force displacement relationship. During a modest initial loading, a majority of the load is carried by the spring, and the force displacement curve is generally linear. As the load increases, the load is shared by the spring and the bar, and the force displacement curve changes. During this portion of the loading, plastic deformation of the NiTi takes place, and the force displacement curve is reversible. As a greater load is applied, the force displacement curve becomes irreversible. Thus, the energy absorbing structure can be reused after the application of relatively modest loads, but must be replaced after the application of greater loads.

Other embodiments of the energy absorbing structure include additional SMA springs and additional porous SMA bars. The energy absorbing structure as disclosed herein can be beneficially incorporated, for example, into airborne vehicles, ground vehicles, and seagoing vehicles, to reduce impact loading under a variety of circumstances. An additional application involves using energy absorbing structures generally consistent with those described above for ballistic protection for military vehicles, military personnel, and law enforcement personnel.

In one embodiment of an energy absorbing structure, as an SMA spring is compressed, a porous SMA element is exposed to a load, and as the porous SMA element is loaded, the porous SMA contacts the SMA spring. This configuration is substantially like a pillar with a side constraint. The function of the side constraint is to increase the buckling load that the porous SMA element can withstand. A plurality of such pillars can be used together to achieve a dampening mechanism for implementation in vehicles, for example, in energy absorbing automotive bumpers. The energy absorbing properties of such a structure can also be beneficially used in medical devices and in many other applications.

This Summary has been provided to introduce a few concepts in a simplified form that are further described in detail below in the Description. However, this Summary is not intended to identify key or essential features of the claimed subject matter, nor is it intended to be used as an aid in determining the scope of the claimed subject matter.

DRAWINGS

Various aspects and attendant advantages of one or more exemplary embodiments and modifications thereto will become more readily appreciated as the same becomes better understood by reference to the following detailed description, when taken in conjunction with the accompanying drawings, wherein:

FIG. 1 schematically illustrates an SPS system;

Figure 3A:
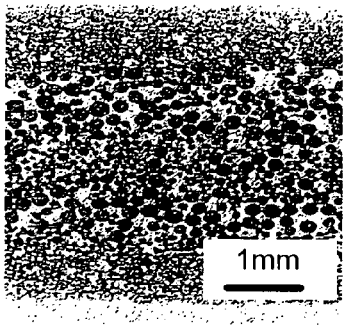
FIG. 3A is an image of the microstructure of a NiTi specimen exhibiting a 25% porosity.
Figure 3B:
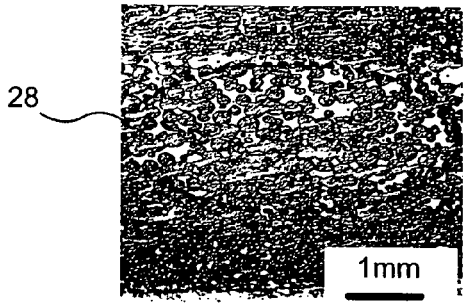
FIG. 3B is an image of the microstructure of a NiTi specimen exhibiting a 13% porosity.
Figure 4A:
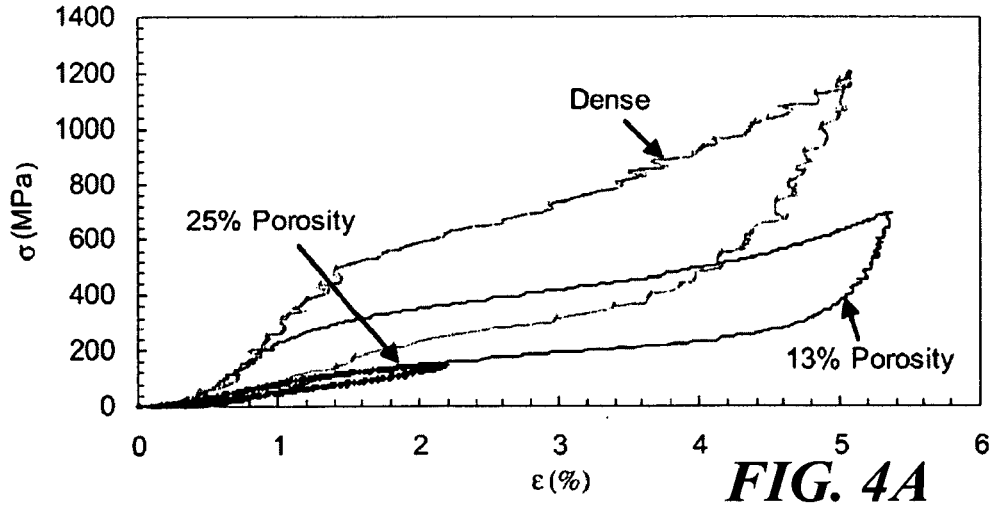
Figure 4B:
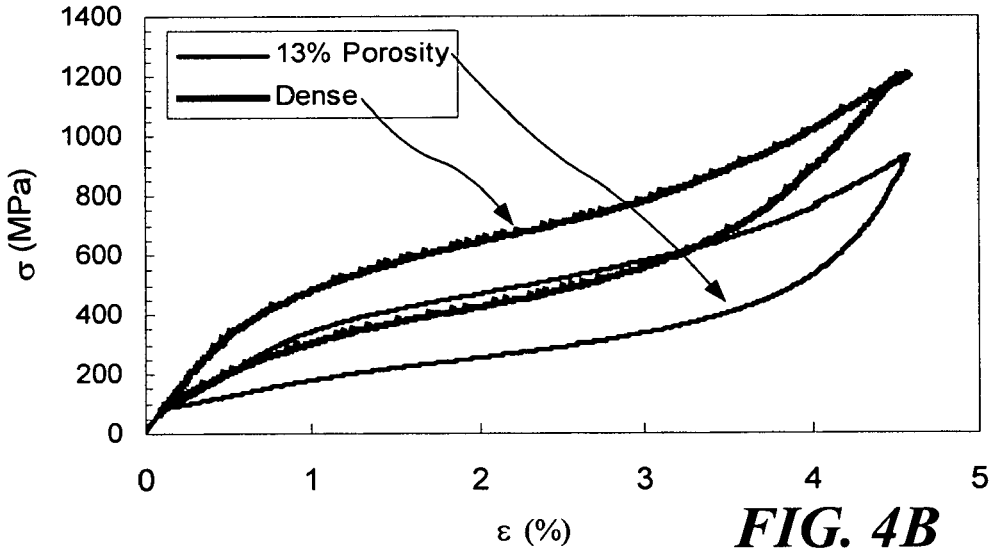
Figure 6C:
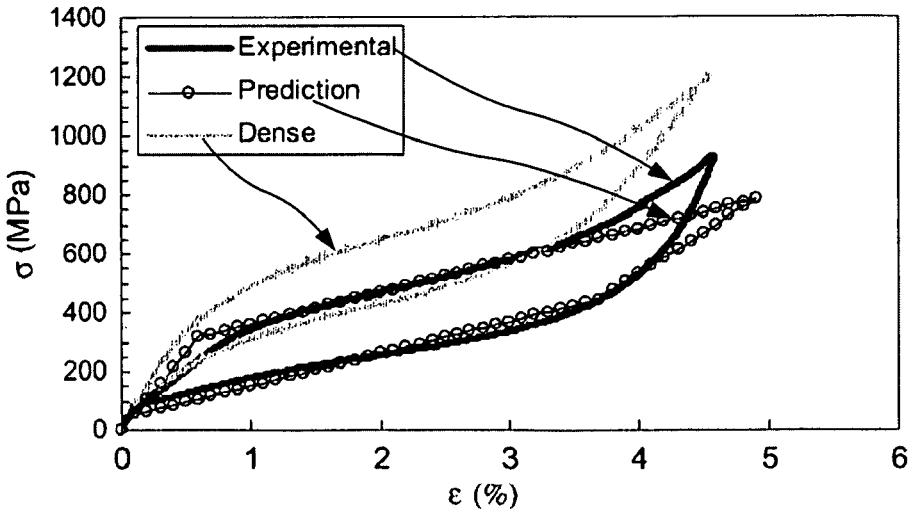
Figure 6A:
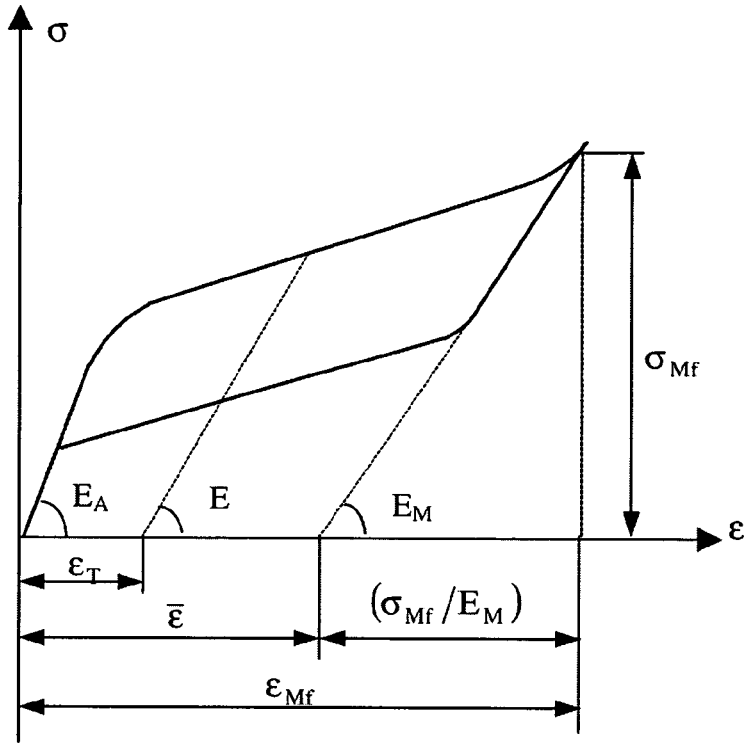
Figure 6B:
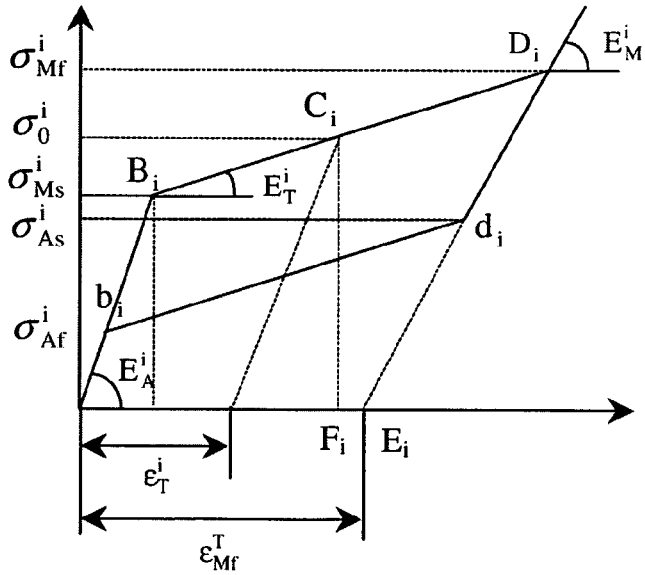
Figure 7A:
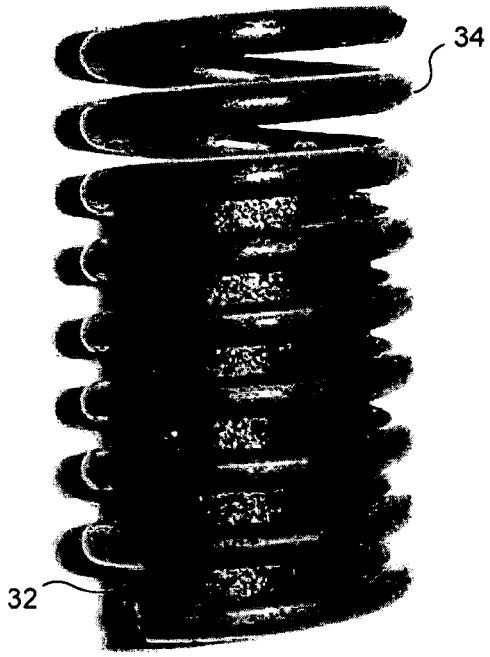
Figure 7B:
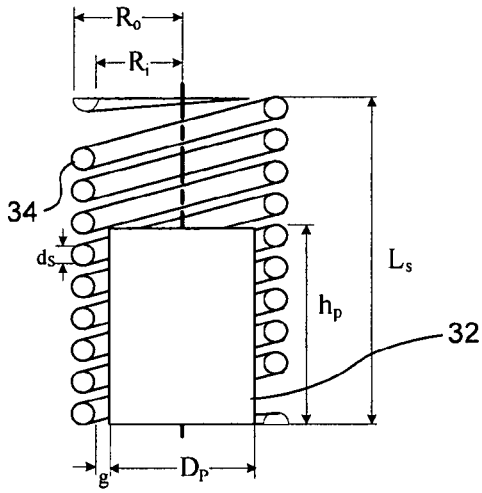
Figure 7C:
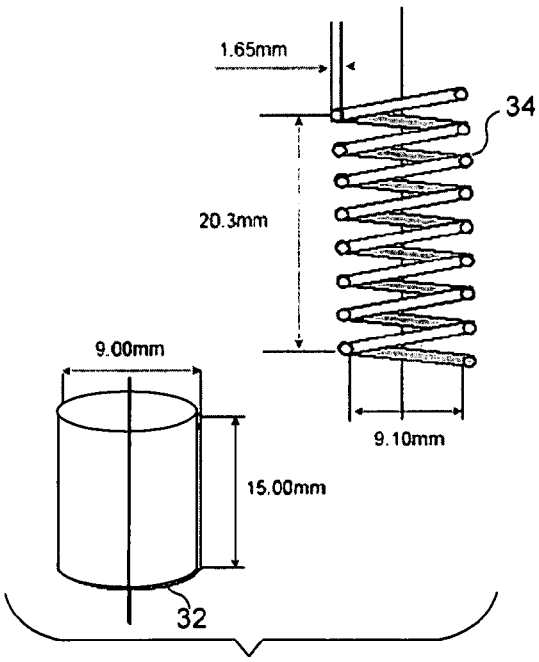
Figure 7D:
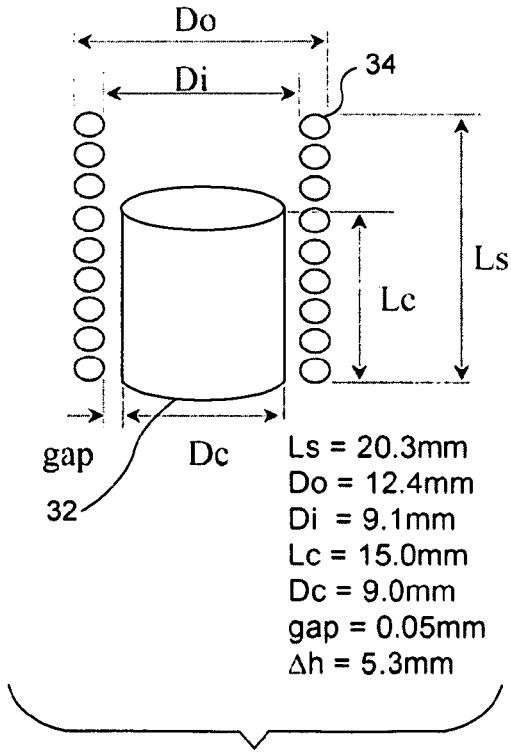
Figure 10A:
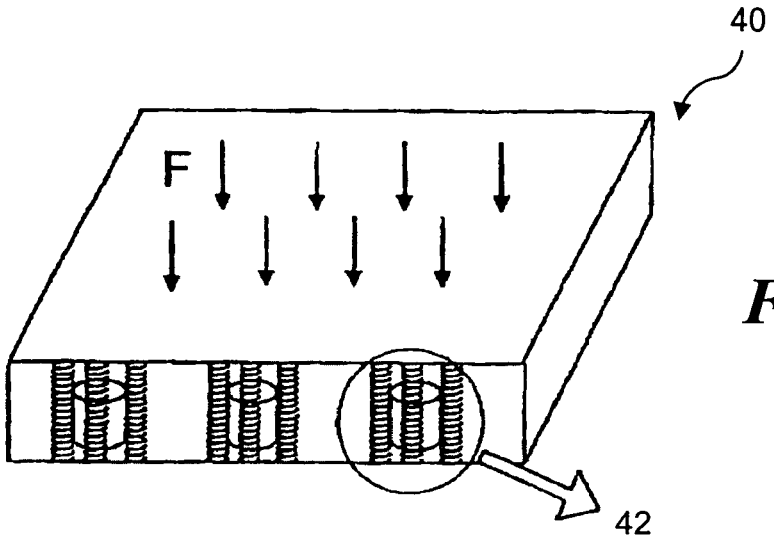
Figure 10B:
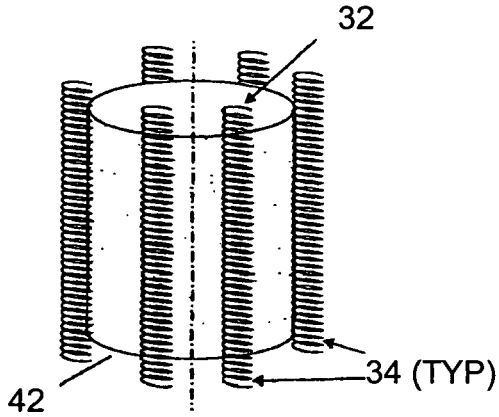
Figure 10C:
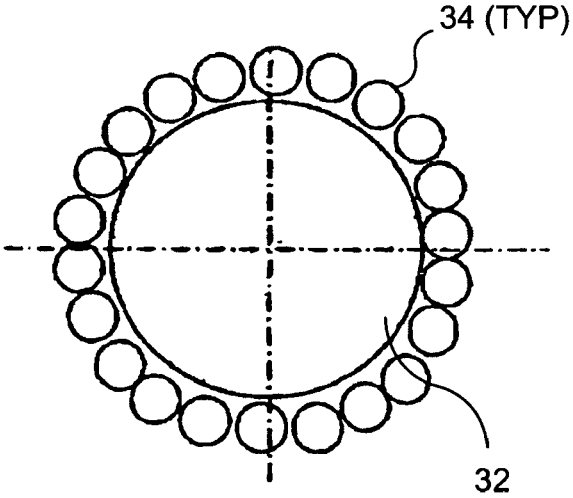

FIG. 4A graphically illustrates the compressive stress-strain curves of a dense NiTi specimen, the 25% NiTi specimen of FIG. 3A, and the 13% NiTi specimen of FIG. 3B, when tested at room temperature;

FIG. 4B graphically illustrates the compressive stress-strain curves of a dense NiTi specimen and the 13% NiTi specimen of FIG. 3B tested at temperatures greater than their austenite finish temperatures;

FIGS. 5A-5C are optical micrographs of samples of the 13% porosity NiTi specimen;

FIG. 6A graphically illustrates an idealized compressive stress-strain curve, including a super elastic loop, for both dense NiTi and porous NiTi;

FIG. 6B graphically illustrates a linearized compressive stress-strain curve (based on FIG. 6A), including three distinct stages, for both dense NiTi and porous NiTi;

FIG. 6C graphically compares the stress and strain curves for the dense NiTi and the 13% porous NiTi, and a stress and strain curve predicted using a model based on FIG. 6B;

FIG. 7A is an image of an energy absorbing structure that includes a porous NiTi rod, and a NiTi spring;

FIG. 7B schematically illustrates an energy absorbing structure including a porous NiTi rod and a NiTi spring;

FIGS. 7C and 7D schematically illustrate dimensions for exemplary energy absorbing structures including a porous NiTi rod and a NiTi spring;

FIGS. 8A-8C schematically illustrate an energy absorbing structure in accord with those described herein under various loading conditions;

FIG. 9A graphically illustrates a force displacement curve of a single porous NiTi rod;

FIG. 9B graphically illustrates a force displacement curve of the exemplary energy absorbing structure of FIGS. 7A and 7B;

FIG. 10A schematically illustrates an energy absorbing structure including a plurality of porous NiTi rods and NiTi springs; and FIGS. 10B and 10C schematically illustrate an energy absorbing structure including a single porous NiTi rods and a plurality of NiTi springs.

DESCRIPTION

Figures and Disclosed Embodiments are not Limiting

Exemplary embodiments are illustrated in referenced Figures of the drawings. It is intended that the embodiments and Figures disclosed herein are to be considered illustrative rather than restrictive.

Overview

The disclosure provided herein encompasses a method for producing a ductile porous SMA using SPS, a model developed to predict the properties of a porous SMA, and an energy absorbing structure that includes a generally nonporous SMA portion and a porous SMA portion, to achieve a lightweight energy absorbing structure having desirable properties.

Production of a Ductile and Porous SMA Using SPS

One advantage of using SPS to generate a porous SMA is that strong bonding among super elastic grade SMA powders can be achieved relatively quickly (i.e., within about five minutes) using a relatively low sintering temperature, thereby minimizing the production of undesirable reaction products, which often are generated using conventional sintering techniques.

Figure 1:
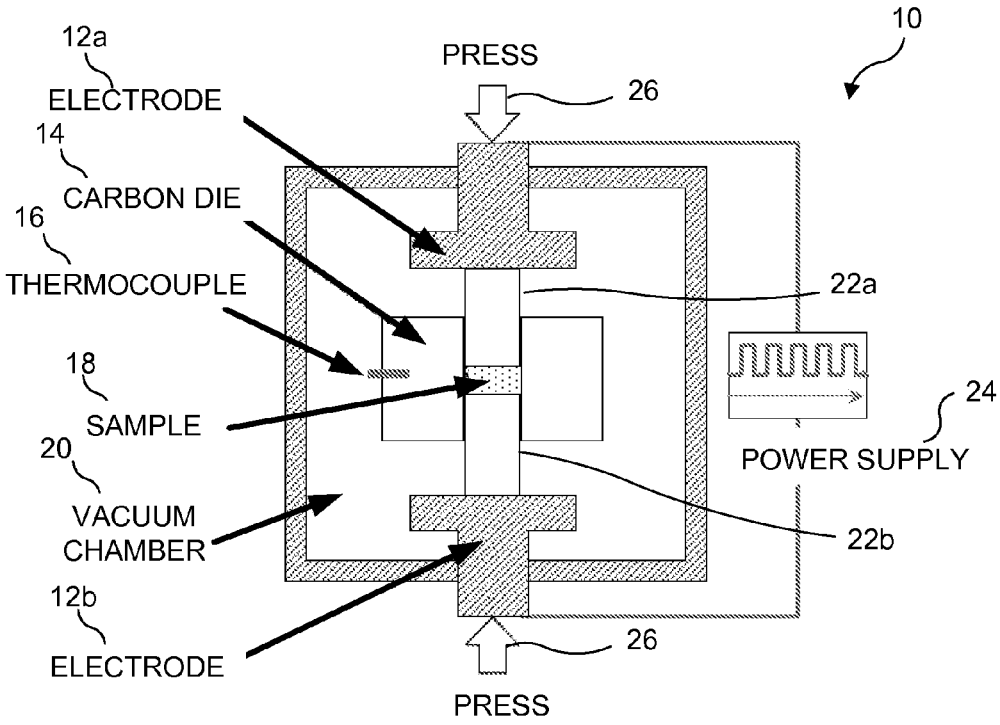
FIG. 1 PRIOR ART

SPS uses a combination of heat, pressure, and pulses of electric current, and generally operates at lower temperatures than the conventional sintering techniques discussed above. The SPS method comprises three main mechanisms: (1) the application of uni-axial pressure; (2) the application of a pulsed voltage; and (3) the heating of the pressure die (generally a graphite die) and the sample. FIG. 1 schematically illustrates an exemplary SPS system 10, including an upper electrode 12*a*, an upper punch 22*a*, a carbon die 14, *a* sample chamber 18, a thermocouple 16, a lower electrode 12*b*, a lower punch 22*b*, a vacuum chamber 20, and a power supply 24. SPS equipment is commercially available from several sources, such as Sumitomo Coal Mining Co. Ltd., Japan (the Dr. Sinter SPS-515S™, and the Dr. Sinter 2050™) and FCT System GmbH, Germany (the FCT-HP D 25/1™).

Significantly, the SPS technique has a short cycle time (e.g., cycle times of a few minutes are common), since the tool and components are directly heated by DC current pulses. The DC pulses also lead to an additional increase of the sintering activity with many materials, resulting from processes that occur on the points of contact of the powder particles (i.e., Joule heating, generation of plasma, electro migration, etc.). Therefore, significantly lower temperatures, as well as significantly lower mold pressures, are required, compared to conventional sintering techniques.

Figure 2:
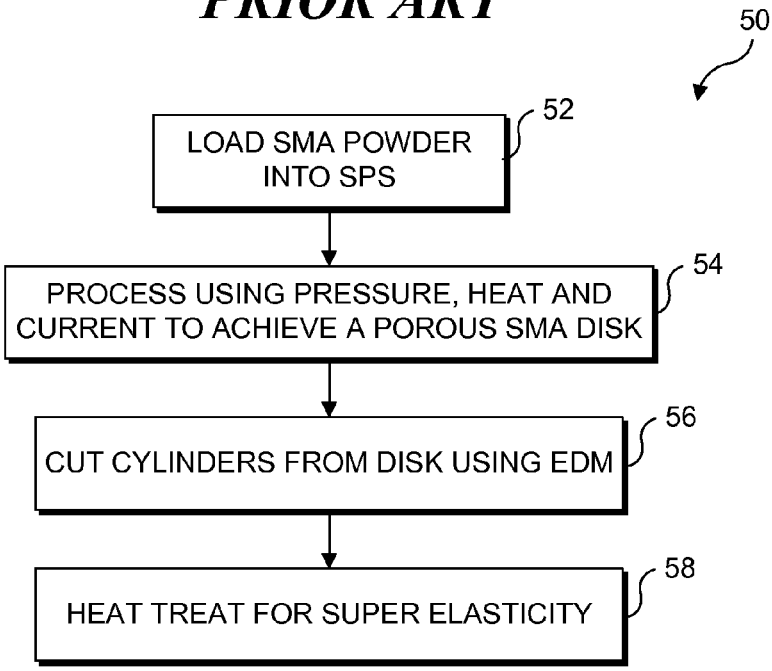
FIG. 2 is a flow chart showing exemplary steps to form a porous SMA using SPS.

FIG. 2 is a flowchart 50 showing exemplary steps that can be carried out to produce a porous SMA component using SPS. In a step 52, a powdered SMA is loaded into the SPS system of FIG. 1. In a step 54, the SPS system is used to sinter the powder employing a combination of pressure, electrical current, and heat (the heat is generally provided by the electrical current, but other heat sources can be used, as long as the thermal effects of the current are accounted for), generating a porous SMA disk. Exemplary processing conditions for NiTi powders are provided below in Table 1. While sintering dies often generate disks, it should be recognized that sintering dies (and the pressure die in the SPS system) can be configured to produce other shapes, thus, the present invention is not limited to the production of a single shape.

In a step 56, the porous SMA disk is processed into more desirable shapes. As described in greater detail below, SMA cylinders can be beneficially employed to produce an energy absorbing structure. Thus, step 56 indicates that the porous SMA disk is processed to generate a plurality of cylinders. Further, step 56 indicates that the processing is performed using EDM. However, it should be recognized that other shapes, and other processing techniques, can be used to produce a desired shape. In a step 58, the porous SMA cylinders are heat treated to ensure that the SMA cylinders are super elastic. An exemplary heat treatment for porous NiTi is to heat the components at about 300° C.-320° C. for about 30 minutes, followed by an ice water quench.

The method steps described in connection with FIG. 2 are exemplary, and it should be understood that they can be modified as desired. For example, if the SPS die is configured to achieve the component shape desired, step 56 can be eliminated. Further, if super elastic grade components are not required, the heat treatment of step 58 can be eliminated.

Empirical Processing of NiTi Specimens Using SPS

Several different studies have been performed to validate the ability of SPS to achieve a ductile and porous SMA. In one study, an ingot of NiTi alloy (Ni (50.9 at. wt. %) and Ti (49.1 at. wt. %); provided by Sumitomo Metals, Osaka, Japan) was processed into powder form using plasma rotating electrode processing (PREP). The average diameter of the NiTi powders processed by PREP is about 150 μm. As noted above, one advantage of the SPS technique is to provide strong bonding among super elastic grade powders (such as NiTi) while a relatively low sintering temperature is maintained for a relatively short time (such as 5 minutes), thus avoiding any undesired reaction products that would be produced by a conventional sintering method.

A summary of three types of specimens processed is provided in Table 1. Each specimen was subjected to the same heat treatment (320° C., 30 min, water quench) to convert them to super elastic grade. Their transformation temperatures were measured using a differential scanning calorimeter chart (Perkin-Elmer, DSC6™ model): $A_s$ (austenite start), $A_f$ (austenite finish), $M_s$ (martensite start) and $M_f$ (martensite finish).

TABLE 1

NiTi Specimens Processed by Spark Plasma Sintering

| Sample | Porosity by volume | SPS Conditions | Transformation Temp. (° C.) |
|---|---|---|---|
| Dense NiTi | 0 | 850° C. under 50 MPa, 5 min | $A_s$ = 23.88, $A_f$ = 43.12<br>$M_s$ = 36.05, $M_f$ = 23.09 |

TABLE 1-continued

NiTi Specimens Processed by Spark Plasma Sintering

| Sample | Porosity by volume | SPS Conditions | Transformation Temp. (° C.) |
|---|---|---|---|
| 13% porous NiTi | 13% | 800° C. under 25 MPa, 5 min | $A_s$ = 19.3, $A_f$ = 38.82<br>$M_s$ = 20.65, $M_f$ = 5.39 |
| 25% porous NiTi | 25% | 750° C. under 5 MPa, 5 min | $A_s$ = 14.59, $A_f$ = 33.29<br>$M_s$ = 23.24, $M_f$ = 2.55 |

The porosity of the specimens was measured using the formula, $f_p=1-M/(\rho V)$, where V and m are respectively the volume and mass of the porous specimen. The density ρ is the density of NiTi (i.e., 6.4 g/cm$^3$) as measured by the mass-density relationship $\rho=m_D/V_D$. The unit of ρ is g/cm$^3$, and $V_D$ and $m_D$ are respectively the volume and mass of the dense NiTi specimen. The porous specimens exhibited a functionally graded microstructure, in that NiTi powders of smaller size are purposely distributed near the top and bottom surfaces while the larger sized NiTi powders are located in mid-thickness region, as indicated in FIG. 3A (an image of the 25% porosity NiTi), and FIG. 3B (an image of the 13% porosity NiTi). The 13% porosity NiTi specimen exhibited continuous NiTi phase throughout its thickness, with porosity centered at mid-plane (as indicated by an area 28), while in the 25% porosity specimen, porosity is distributed throughout the thickness, with less porosity towards the top and bottom surfaces ("top" and "bottom" being relative to the specimen as shown).

Figure 3C:
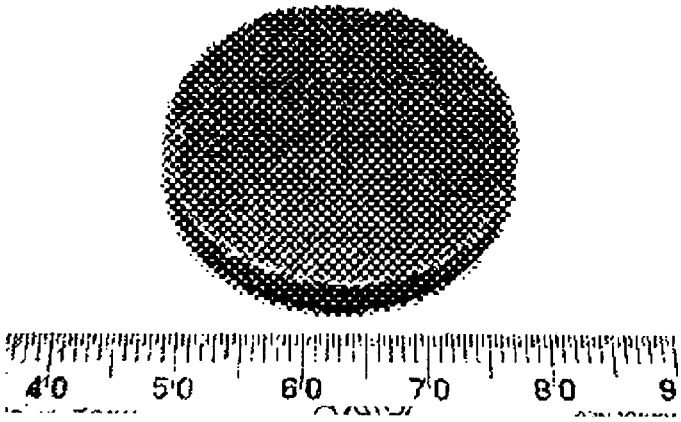
FIG. 3C is an image of a porous NiTi disk formed using SPS.
Figure 3D:
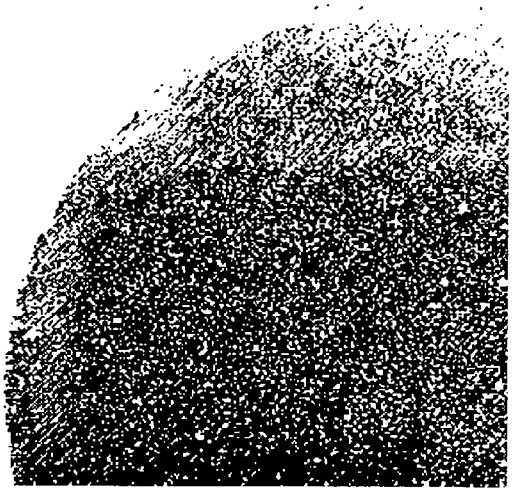
FIG. 3D is an enlarged image of a portion of the porous NiTi disk of FIG. 3C.
Figure 3E:
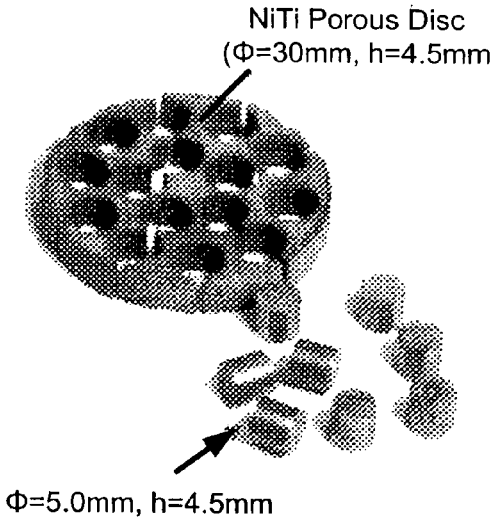
FIG. 3E is an image of the porous NiTi disk of FIG. 3C processed into desirable shapes using electro discharge machining (EDM)

FIG. 3C is an image of a porous NiTi disk fabricated using SPS, while FIG. 3D is an enlarged image of a portion of the NiTi disk. FIG. 3E shows how the disk was processed using EMD to form porous NiTi/SMA cylinders. The NiTi cylinders were tested as described below.

Two types of compressive tests were conducted (using an Instron tensile frame; model 8521™) to obtain the stress-strain curves of both the dense and the porous (25% and 13%) NiTi. Two different testing temperatures were used: (1) room temperature (22° C.); and (2) a temperature 15-25° C. higher than the austenite finish temperature ($A_f$) of the specimen. The porous specimens, with porosities of 13% and 25%, and the dense specimen were each tested under a static compressive load (loading rate $10^{-5}$ s$^{-1}$). The results are graphically illustrated in FIG. 4A. The 25% porosity NiTi specimen exhibits the lowest flow stress level and the least super elastic loop behavior, while both the 13% porosity NiTi specimen and the dense NiTi specimen clearly exhibit larger super elastic loops, and greater ductility. The main reason for the better super elastic behavior of the 13% porosity NiTi specimen processed by SPS technique described above is the rather continuous connectivity between adjacent NiTi powders of super elastic grade in the high porosity region (mid-section). In the case of the 25% porosity NiTi specimen, such connectivity is not established in the mid-section (i.e., there is non-uniform connectivity). In addition, the 25% porosity NiTi specimen appears to include clusters of NiTi powder particles, which at least in part have converted to undesirable brittle inter-metallics. Such conversion can occur due to hot spots in the NiTi powder during the SPS process. When stress is sufficiently large, the collapse of imperfect necking structures among large NiTi particles in the 25% porosity specimen leads to the specimen exhibiting a relatively low strength, rather than the desired super elasticity. Based on the results of the compression testing, the 13% porosity specimen was selected for further testing.

FIGS. 5A-5C are optical micrographs of samples of the 13% porosity NiTi specimen. FIG. 5A is an optical micrograph of a sample of the 13% porosity NiTi specimen before the compression test. FIG. 5B is an optical micrograph of a sample of the 13% porosity NiTi specimen after being loaded to achieve a 5% compression, and subsequent unloading. FIG. 5C is an optical micrograph of a sample of the 13% porosity NiTi specimen after being loaded to achieve a 7% compression, and subsequent unloading. FIG. 5B indicates that the 13% porosity NiTi remains super elastic when compressed to about 5%, because after unloading, the material returns to the uncompressed configuration shown in FIG. 5A. In contrast, FIG. 5C indicates that the 13% porosity NiTi undergoes plastic deformation when compressed to about 7%. This behavior is due to the material being in the martensitic phase.

FIGS. 5A and 5B support the conclusion that the 13% porosity NiTi specimen processed as described above (SPS followed by heat treatment) deforms super elastically, contributing to its high ductility. On the other hand, the microstructure of the 25% porosity sample exhibits a markedly different microstructure, which appears to explain why the compressive stress-strain curve of the 25% porosity NiTi exhibits a much lower flow stress.

As noted above, compression testing was performed both at room temperature, and at a temperature greater than the austenite finish temperature of the material. FIG. 4B graphically illustrates the compressive stress-strain curves of the 13% porosity NiTi specimen and the dense NiTi specimen. The compressive stress-strain curves tested at $T>A_f$ more clearly exhibit a super elastic loop at higher flow stress level when compared to the compressive stress-strain curves tested at room temperature (FIG. 4A). This result is due to the fact that NiTi exhibits super elastic behavior at higher flow stress levels, at higher temperatures.

With respect to FIG. 4A (room temperature), note that while the data for the 25% porosity material does show a super elastic loop, the stress-strain curve for the 25% porosity material does not correlate very well to the characteristic trapezoidal shape of the stress-strain curve for the dense material. However, the stress-strain curve for the 13% porosity material does correlate very well to the characteristic trapezoidal shape of the stress-strain curve for the dense material. This correlation (indicating that the super elastic properties of the 13% porosity material are quite similar to the super elastic properties of the dense material) is even more apparent when the stress-strain curves are collected above the austenite finishing temperature, as shown in FIG. 4B.

Modeling of the Compressive Stress-Strain Curves of Porous NiTi

In order to optimally design the microstructure and properties of porous SMAs, it is important to develop a simple, yet accurate model to describe the microstructure and mechanical behavior relationships of porous SMAs. If a porous NiTi is treated as a special case of a particle-reinforced composite, a micromechanical model can be applied that is based on Eshelby's method with the Mori-Tanaka mean-field (MT) theory and the self-consistent method. Both methods have been used to model macroscopic behavior of composites with SMA fibers. Young's modulus of a porous material was modeled by using the Eshelby's method with MT theory.

Eshelby's equivalent inclusion method combined with the Mori-Tanaka mean-field theory can thus be used to predict the stress-strain curve of a porous NiTi under compression, while accounting for the super elastic deformation corresponding to the second stage of the stress-strain curve. The predicted stress-strain curve can be compared with the experimental data of the porous NiTi specimen processed by SPS.

The model assumes a piecewise linear stress-strain curve of super elastic NiTi. FIG. 6A graphically illustrates an idealized compressive stress-strain curve, including a super elastic loop, for both dense NiTi and porous NiTi. FIG. 6B graphically illustrates a linearized compressive stress-strain curve (based on FIG. 6A), including three distinct stages, for both dense NiTi and porous NiTi. FIG. 6C graphically illustrates stress and strain curves for the dense NiTi and the porous NiTi, and a stress and strain curve predicted using the model described in detail below.

Referring to the idealized stress-strain curve of FIG. 6B, a first linear part, $A_iB_i$, corresponds to the elastic loading of the 100% austenite phase. A second linear part, $B_iD_i$, corresponds to the stress-induced martensite transformation plateau. $D_id_i$ corresponds to the unloading of the 100% martensite phase, and $d_ib_i$ corresponds to the reverse transformation lower plateau. A final linear part is $b_iA_i$ which corresponds to the elastic unloading of the 100% austenite phase. The subscript "i" in FIG. 6B denotes both dense (i=D) and porous NiTi (i=P), since the idealized curve applies to both cases.

The stress-strain curve of FIG. 6A includes both a loading curve and an unloading curve, which collectively generate the characteristic super elastic loop. Models for the loading curve and unloading curve are discussed below.

With respect to a model for the loading curve, the compressive stress-strain curve of the 13% porosity specimen of FIG. 4B exhibits three stages (as indicated in FIG. 6B and as discussed above): first stage $A_iB_i$ (the 100% austenite phase); second stage $B_iD_i$ (the upper plateau, corresponding to the stress-induced martensite phase); and third stage $D_id_i$ (the 100% martensite phase). Although the compressive stress-strain curves for these three stages shown in FIG. 4B do not completely correspond to the linear stages shown in FIG. 6B, for the purposes of modeling the loading curve for the 13% porosity specimen of NiTi, it can be assumed that each stage is linear. Using that assumption, a simple model of the three piecewise linear stages can be based on Eshelby's effective medium model and the Mori-Tanaka mean-field theory. The slopes of the linearized first, second, and third stages of the 13% porous NiTi specimen are respectively defined as $E_{Ms}$, $E_T$, and $E_{Mf}$, where the subscripts $M_s$, T, and $M_f$ respectively denote the first stage with the martensite phase start (equivalent to the 100% austenite phase), the second stage linearized slopes with tangent modulus, and the third stage with the martensite finish (i.e., the 100% martensite phase). The stresses at the transition between the first and second stages and between the second and third stages are denoted by $\sigma_{M_s}^P$, and $\sigma_{M_f}^P$, respectively, where the superscript 'P' denotes the porous NiTi. Therefore, the calculation of the moduli $E_{M_s}$, $E_T$, and $E_{M_f}$, as well as the martensitic transformation start stress, $\sigma_{M_s}^P$, and the martensitic transformation finish stress, $\sigma_{M_f}^P$, are the keys to this model.

Note that with respect to the model for the unloading portion of the stress-strain curve discussed below, no uniform strain and stress in the matrix NiTi is assumed. With respect to determining critical stresses, note that the start and finish martensitic transformation stresses $\sigma_{M_s}^P$ and $\sigma_{M_f}^P$ can be obtained using the relationships in Eq. (1a) and Eq. (1b), which follow:

$$\sigma_{M_s}^P = (1 - f_p)\sigma_{M_s}^D, \tag{1a}$$

$$\sigma_{M_f}^P = (1 - f_p)\sigma_{M_f}^D, \tag{1b}$$

where $\sigma_{M_s}^D$ and $\sigma_{M_f}^D$ are respectively, the start and finish martensitic transformation stresses that are averaged in the matrix domain.

To determine the stiffness of the first and third stages, a formula based on Eshelby's model and the Mori-Tanaka mean-field theory can be used to calculate the Young's modulus of a porous material, as follows:

$$\frac{E^P}{E^D} = \frac{1}{1 + nf_p}, \tag{2}$$

where for spherical pores, η is given by $$n = \frac{15}{7(1 - f_p)}, \tag{3}$$

A brief derivation of Eqs. (2) and (3) is provided in Appendix A.

Determination of the stiffness of the second stage can be obtained as follows. The Young's modulus (E) of a NiTi with transformation $\epsilon_T$ is estimated by:

$$E(\varepsilon_T) = E_A + \frac{\varepsilon_T}{\bar{\varepsilon}}(E_M - E_A), \tag{4}$$

where $E_A$ and $E_M$ are respectively the Young's modulus of the 100% austenite and the 100% martensite phase, and $\bar{\epsilon}$ is the maximum transformation strain, which can be obtained using the following relationship:

$$\bar{\varepsilon} = \varepsilon_{M_f} - \frac{\sigma_{M_f}}{E_M}, \tag{5}$$

Eq. (4) is valid for both the dense and the porous NiTi (13%); thus, Eqs. (4) and (5) can be rewritten as follows:

$$E^i = E_A^i - \frac{E_A^i - E_M^i}{\varepsilon_{M_f}^i - \sigma_{M_f}^i / E_M^i}\varepsilon_T, \tag{6}$$

where the superscript 'i' denotes i=D (dense) or P (porous). In order to obtain the slope of the linearized second stage of the compressive stress-strain curve of a porous NiTi, the equivalency of the strain energy density must be considered. However, in the case of the second stage, the macroscopic strain energy density of porous NiTi should be evaluated from the trapezoidal area of FIG. 6B, i.e., the trapezoid $B_iC_iF_iH_i$, where i=P for an arbitrary transformation strain $\epsilon_T^P$. Therefore, the macroscopic strain energy density of porous NiTi with $\epsilon_T^P$ calculated graphically from FIG. 6C is given by:

$$W = \frac{1}{2}(\sigma_{M_s}^P + \sigma_0^P)\left(\varepsilon_T^P + \frac{\sigma_0^P}{E_{AM}} - \frac{\sigma_{M_s}^P}{E_{M_s}}\right), \tag{7}$$

where $\sigma_{M_s}^P$ is the start martensitic transformation stress of the porous NiTi material, $\sigma_0^P$ is an applied stress, and $\epsilon_T^P$ is the strain corresponding to $\sigma_0^P$ (see FIG. 6B). Since there is no transformation strain in pores, the transformation strain for porous NiTi, $\epsilon_T^P$, is the uniform transformation strain in the dense NiTi, $\epsilon_T^D$. Thus, $$\epsilon_T^P = \epsilon_T^D \equiv \epsilon_T, \tag{8}$$

The macroscopic strain energy density determined above is set equal to the microscopic strain energy density, which is calculated using Eshelby's inhomogeneous inclusion method, such that:

$$W = \frac{1}{2}C_{ijkl}^{m-1}\sigma_{ij}^0\sigma_{kl}^0 + \frac{1}{2}f_P\sigma_{ij}^0\varepsilon_{kl}^*, \tag{9}$$

where the corresponding Eshelby's problem provides the solution for $\epsilon^*_{ij}$ as:

$$\varepsilon_{kl}^* = \varepsilon_{kl}^T - \frac{1}{1 - f_P}(S_{klmn} - I)^{-1}C_{ijkl}^{m-1}\sigma_{ij}^0, \tag{10}$$

Substituting Eq. (10) into Eq. (9), the microscopic strain energy density, W, is given by:

$$W = \frac{1}{2}\sigma_{ij}^0\varepsilon_{ij}^0 + \frac{1}{2}f_P\sigma_{ij}^0\left[2\varepsilon_{ij}^T - \frac{1}{1 - f_P}(S_{ijkl} - I)^{-1}\varepsilon_{kl}^0\right], \tag{11}$$

Since the porous NiTi is subjected to uni-axial load (i.e., $\sigma_{ij}^0 = \{0,0,\sigma_0^P,0,0,0\}^T$, and $\epsilon_{ij}^T = \{\nu\epsilon_T, \nu\epsilon_T - \epsilon_T, 0,0,0\}^T$), and the pores are assumed to be spherical, Eq. (11) can be reduced to:

$$W = \frac{1}{2}\sigma_0^P\varepsilon_0 + \frac{1}{2}f_P\sigma_0^P\left[2\varepsilon_T + \frac{15}{7(1-f_P)}\varepsilon_0\right], \tag{12}$$

where $\epsilon_0$ is the macroscopic strain of the porous NiTi, and it is related to applied stress $\sigma_0^P$ as:

$$\varepsilon_0 = \frac{\sigma_0^P}{E_{AM}}, \tag{13}$$

Substituting Eq. (13) into Eq. (12), the microscopic strain energy density W of the porous NiTi is finally reduced to:

$$W = \frac{1}{2}\frac{(\sigma_0^P)^2}{E_{AM}} + \frac{1}{2}f_P\sigma_0^P\left[2\varepsilon_T^P - \frac{15}{7(1-f_P)}\frac{\sigma_0^P}{E_{AM}}\right], \tag{14}$$

where $E_{AM}$ is the Young's modulus of dense (matrix) NiTi with $\epsilon_T$.

By equating the macroscopic strain energy density of Eq. (7) to the microscopic strain energy density of Eq. (14), and using Eq. (6) with i=P, an algebraic equation of second-order in terms of $\epsilon_T$ is obtained, as follows:

$$A(\varepsilon_T)^2 + B\varepsilon_T + C = 0, \tag{15}$$

where $$A = \frac{(\gamma\sigma_0^P + \sigma_{M_s}^P)(1-\beta)}{\varepsilon_{M_s}},$$

$$B = \gamma\sigma_0^P + \sigma_{M_s}^P + \frac{\sigma_{M_s}^P(1-\beta)(\sigma_{M_s}^P + \sigma_0^P)}{E_{M_s}\varepsilon_{M_f}},$$

$$C = \frac{(1-\alpha)(\sigma_0^P)^2 - (\sigma_{M_s}^P)^2}{E_{M_s}}$$

and $$\alpha = 1 - \frac{f_p}{1-f_P}(S_{3333}-1)^{-1},\ \beta = \frac{E_{M_f}}{E_{M_s}},\ \gamma = 1 - 2f_P,$$

Solving for $\epsilon_T^P$, which corresponds to the second kink point, $D_P$ of FIG. 6B (i.e., see $D_i$), the following is obtained:

$$\varepsilon_T = \frac{-B + \sqrt{B^2 - 4AC}}{2A}, \tag{16}$$

The tangent modulus of the porous NiTi is the slope of the second portion of the stress-strain curve shown in FIG. 6B, thus, $E_T$ can be expressed in terms of transformation strain and the stresses:

$$E_T = \frac{\sigma_0^P - \sigma_{M_s}^P}{\varepsilon_T}, \tag{17}$$

Referring now to the unloading curve portion of the idealized stress-strain curve of FIG. 6B, note that during unloading, the porous NiTi material undergoes transformation (from the martensite phase to the austenite phase).

Before the applied stress reaches the critical value $\sigma_{A_s}^P$, the matrix of the NiTi remains in a 100% martensite phase (the first stage of the unloading stress-strain curve in the modeling curve).

When the applied stress is decreased to $\sigma_{A_s}^P$, reverse transformation begins. The reverse transformation finishes when the stress reaches another critical value, $\sigma_{A_f}^P$, thereafter the porous NiTi material remains 100% austenite.

Therefore, the slopes of the first and third stages of the unloading curve are the Young's moduli of the 100% martensite and the 100% austenite phase, respectively. The slope of the second stage is the same as that of the loading curve. Therefore, the Young's moduli of the unloading curve are related to those of the loading curve as:

$$E_{A_s} = E_{M_f}, \tag{18a}$$

$$E_T^u = E_T, \tag{18b}$$

$$E_{A_f} = E_{M_s}, \tag{18c}$$

where $\epsilon_T^u$ is the slope of the second stage of the unloading curve. The superscript 'u' denotes unloading, and the components without superscripts are the slopes of loading curve.

The start and finish austenite transformation stresses of porous NiTi, $\sigma_{A_s}^P$ and $\sigma_{A_f}^P$ are related to the corresponding stresses of the dense NiTi:

$$\sigma_{A_s}^P = (1-f_P)\sigma_{A_s}^D, \tag{19a}$$

$$\sigma_{A_f}^P = (1-f_P)\sigma_{A_f}^D, \tag{19b}$$

where $\sigma_{A_s}^D$ and $\sigma_{A_f}^P$ are respectively the start and finish austenite transformation stresses of the dense NiTi. First, it is assumed that the dense NiTi matrix is isotropic, with a Poisson's ratio $\nu^A = \nu^M = 0.33$. Input data measured from the idealized compressive stress-strain curve of FIG. 4B are shown in Table 2.

TABLE 2

| Input Data | | | | | | |
|---|---|---|---|---|---|---|
| $\sigma_{M_s}^D$ (MPa) | $\sigma_{M_f}^D$ (MPa) | $\sigma_{A_f}^D$ (MPa) | $E_A$ (GPa) | $E_M$ | $\epsilon_{M_s}$ | $\epsilon_{M_f}$ |
| 400 | 720 | 300 | 75 | 31 | 0.004 | 0.032 |

In the empirical testing of the porous and solid NiTi specimens discussed above, SPS was used to generate porous NiTi exhibiting two different porosities, 13% and 25%. The 13% porosity NiTi appears to possess a desirable microstructure with a high ductility, while the 25% porosity NiTi specimens exhibits a much lower stress flow than that of the 13% porosity. The piecewise linear stress-strain curve model of the compressive stress-strain curve of the 13% porosity NiTi discussed above predicts the flow stress level of the experimental stress-strain curve reasonably well.

An Energy Absorbing Structure Incorporating Porous NiTi

Having successfully fabricated a porous SMA having good ductility using SPS (the 13% porosity NiTi discussed in detail above), an energy absorbing structure incorporating a porous, ductile and super elastic SMA was designed. The energy absorbing structure includes an SMA member and a porous SMA member.

FIG. 7A is an image of an exemplary energy absorbing structure, including a porous NiTi cylinder 32 and a NiTi spring 34. FIG. 7B schematically illustrates an exemplary configuration, while FIGS. 7C and 7D provide details of exemplary dimensions (although it should be understood that such dimensions are not intended to be limiting). While NiTi represents an exemplary SMA for the spring element, and porous NiTi represents an exemplary porous SMA for the rod/cylinder element, it should also be apparent that the implementation of NiTi for either element is not intended to be limiting. Furthermore, while the spring/cylinder (or spring/rod) configuration is desirable, in that the spring provides a side constraint to increase the buckling load that can be applied to the rod/cylinder, other configurations in which a first SMA element provides a side constraint to a second SMA element can also be implemented. Thus, the SMA element providing a side constraint can be implemented in structural configurations not limited to spring 34, and the second SMA element (the element benefiting from the side constraint) can be implemented using structures other than a rod/cylinder.

The concept of the SMA composite structure of FIGS. 7A-7D is to provide a structure that behaves super-elastically for modest to intermediate impact loading (and is thus reusable for future impact loadings), and which also can adsorb larger loads, particularly after the porous cylinder swells horizontally, thus touching the outer spring. FIGS. 8A-8C schematically illustrate the exemplary energy absorbing structure under loading. In FIG. 8A, an initial load is received by NiTi spring 34. In FIG. 8B, the load has caused spring 34 to compress, and part of the load is now applied to cylinder 32 as well. In FIG. 8C, additional loading causes cylinder 32 to deform, such that the walls of the cylinder touch the spring (which provides a side constraint to the cylinder, increasing the buckling load that can be absorbed by the cylinder). A gap between cylinder 32 and the coils of spring 34 is selected such that when a sufficient load is applied to cylinder 32, deformation of the cylinder causes the cylinder to contact the coils of spring 34, increasing the super elastic loading of the cylinder, as explained below in connection with FIGS. 9A and 9B, and as shown below in Table 3.

FIG. 9A graphically illustrates a force displacement curve of a single porous NiTi rod, while FIG. 9B graphically illustrates a force displacement curve of the exemplary energy absorbing structure of FIGS. 7A and 7B. Obviously, the energy absorbing structure of FIGS. 7A and 7B is able to support a larger force and displacement. For the porous NiTi rod, the spring plays a role as a constraint, and the porous NiTi rod and surrounding spring (i.e., the exemplary energy absorbing structure) exhibits a higher super elastic force, a higher fracture point and larger displacement than does the porous NiTi rod without the spring. On the other hand, the porous NiTi rod acts as a yoke for the spring, preventing it from asymmetric deformation (i.e., premature buckling) when subjected to large force.

The following discussion of FIGS. 9A and 9B relates to the energy absorbing (EA) capacity under reversible loading (i.e., super elastic loading) and irreversible loading (loading all the way to a fracture point) of selected specimens. For reversible loading, EA is defined as the area encompassed by the super elastic loop, while for irreversible loading, EA is defined as the area under the force-displacement curve up, to the fracture point marked in each Figure by an X. The two values of EA are divided by the mass of each specimen to calculate a specific EA. Key mechanical data (including specific EAs) are listed in Tables 3 and 4. The data (and FIGS. 3A and 3B) demonstrate the advantage of using the composite structure (i.e., the exemplary energy absorbing structure of FIGS. 7A and 7B) rather than employing a porous NiTi rod without a constraint, to cope with a wide range of compressive loads.

FIG. 10A schematically illustrates an energy absorbing structure 40 including a plurality of substructures 42, each substructure including a porous NiTi rod and a plurality of NiTi springs. FIGS. 10B and 10C provide details of the configuration of substructures 42.

TABLE 3

Comparison of Experimental Data for a Single Porous NiTi Rod and the Exemplary Energy Absorbing Structure

| | Maximum Reversible Displacement | Maximum Reversible Force | Fracture Displacement | Fracture Force | Specific Energy Absorption |
|---|---|---|---|---|---|
| Single Porous NiTi Rod | 1.29 mm | 40.74 KN | 2.03 mm | 65.15 KN | 12.2 MJ/Mg |
| Exemplary Structure | 7.01 mm | 68.76 KN | 7.71 mm | 97.21 KN | 15.3 MJ/Mg |

TABLE 4

Comparison of the Specific EA of Various Materials

| Materials | $AlCu_4$ Foam | Al w/Si added | Al | 13% porosity NiTi rod | Composite structure |
|---|---|---|---|---|---|
| NRG Absorption ($MJ/m^3$) | 5.2 | 4.2 | 20 | 68.3 | 141.5 |

In summary, the exemplary energy absorbing structure has a dual use as an efficient energy absorber, for both reversible low impact loadings and irreversible high impact loadings. It is noted also that the higher strain-rate impact loading, the higher the flow stress of NiTi becomes, which may be considered an additional advantage of using NiTi as a key energy absorbing material.

In yet another embodiment, the spring is made from conventional materials, and only the inner rod/cylinder is a SMA. The energy absorbing capability of such an embodiment has yet to be investigated.

Although the present invention has been described in connection with the preferred form of practicing it and modifications thereto, those of ordinary skill in the art will understand that many other modifications can be made to the present invention within the scope of the claims that follow. Accordingly, it is not intended that the scope of the invention in any way be limited by the above description, but instead be determined entirely by reference to the claims that follow.

APPENDIX A

The Eshelby's inhomogeneous inclusion problem with the Mori-Tanaka mean-field theory provides the total stress field is given by:

$$\begin{aligned}\sigma_{ij}^0 + \alpha ij &= C_{ijkl}^m[\varepsilon_{kl}^0 + \bar{\varepsilon}_{kl} + \varepsilon_{kl} - (\varepsilon_{kl}^* - \varepsilon_{kl}^T)] \\ &= C_{ijkl}^m(\varepsilon_{kl}^0 + \bar{\varepsilon}_{kl} + \varepsilon_{kl} - \varepsilon_{kl}^{**}) \\ &= C_{ijkl}^p(\varepsilon_{kl}^0 + \bar{\varepsilon}_{kl} + \varepsilon_{kl})\end{aligned} \tag{A1}$$

where $C_{ijkl}^m$ and $C_{ijkl}^P$ are respectively the elastic stiffness tensor of matrix and pores; $\sigma_{ij}$ and $\epsilon_{kl}$ are respectively the stress disturbance and the strain disturbance due to the existence of pores; $\bar{\epsilon}_{kl}$ is the average strain disturbance in the matrix due to the pores; and $\epsilon^*_{ij}$ is a fictitious eigen strain which has non-vanishing components. To facilitate solving Eshelby's formula, $\epsilon^{**}_{kl}$, defined below in Eq. (A2), is introduced.

$$\epsilon^{**}_{kl} = \epsilon^*_{kl} - \epsilon_{kl}^T, \tag{A2}$$

For the entire composite domain, the following relationship always holds:

$$\sigma_{ij}^0 = C_{ijkl}^m \epsilon_{kl}^0, \tag{A3}$$

From Eshelby's equation, the strain disturbance is related to $\epsilon^{**}_{mn}$ as:

$$\epsilon_{kl} = S_{klmn}\epsilon^{**}_{mn}, \tag{A4}$$

The requirement that the integration of the stress disturbance over the entire body vanishes leads to:

$$\bar{\epsilon}_{kl} = -f_P(S_{klmn}\epsilon^{}_{mn} - \epsilon^{}_{kl}I). \tag{A5}$$

$S_{klmn}$ is the Eshelby's tensor for pores derived in Appendix B (below). A substitution of Eqs. (A3), (A4), and (A5) into Eq. (A1), and use of $C_{ijkl}^P = 0$ (due to the pores) provides the following solution for $\epsilon^{}_{kl}$, $$\varepsilon_{kl}^{} = -\frac{1}{1 - f_p}(S_{klmn} - I)^{-1} C_{ijkl}^{-1} \sigma_{ij}^0. \tag{A6}$$

The equivalency of the strain energy density of the porous NiTi leads to:

$$\frac{\sigma_0^2}{2E^P} = \frac{\sigma_0^2}{2E^D} + \frac{f_P}{2}\sigma_0\varepsilon_{33}^{**}, \tag{A7}$$

where the applied stress $\sigma_0$ is assumed to be along $x_3$-axis.

APPENDIX B

Eshelby's Tensor for Sphere Inclusion $$S_{1111} = S_{2222} = S_{3333} = \frac{7 - 5v}{15(1 - v)},$$

$$S_{1122} = S_{2233} = S_{3311} = S_{2211} = S_{3322} = \frac{5v - 1}{15(1 - v)},$$

$$S_{1212} = S_{2323} = S_{3131} = \frac{4 - 5v}{15(1 - v)},$$

The invention in which an exclusive right is claimed is defined by the following:

1. An energy absorbing structure comprising a first shape memory alloy (SMA) member and a second SMA member, wherein the first SMA member is disposed externally of the second SMA member, spaced apart by a gap from the second SMA member when the energy absorbing structure is not subjected to any stress, and configured to constrain the second SMA member so as to increase a buckling load that the second SMA member can accommodate, the second SMA member comprising a super elastic and ductile sintered SMA exhibiting a porous microstructure, in which interstitial spaces separate adjacent SMA particles, the porous second SMA member exhibiting a trapezoidal stress-strain curve response characteristic of an equivalent SMA exhibiting a dense microstructure under compressive testing performed above an austenite finishing temperature, a performance of the energy absorbing structure being enhanced due to a super elastic deformation of the second SMA member as the second SMA member is stressed about at least two substantially orthogonal axes sufficiently to close the gap, so that the second SMA member contacts and is constrained by the first SMA member.

2. The energy absorbing structure of claim 1, wherein the first SMA member and the second SMA member are coaxially aligned.

3. The energy absorbing structure of claim 1, wherein the first SMA member comprises a spring.

4. The energy absorbing structure of claim 1, wherein an initial load applied to the energy absorbing structure is borne by the first SMA member.

5. The energy absorbing structure of claim 1, wherein deformation of the first SMA member under a load exposes the second SMA member to the load.

6. The energy absorbing structure of claim 1, wherein deformation of the second SMA member under a load causes the second SMA member to contact the first SMA member.

7. The energy absorbing structure of claim 1, wherein the first SMA member is configured to elastically deform under relatively smaller loads, and to constrain the second SMA member only under relatively larger loads.

8. The energy absorbing structure of claim 1, wherein the first SMA member is super elastic.

9. The energy absorbing structure of claim 1, wherein the first and second SMA members comprise an alloy that includes nickel and titanium.

10. An energy absorbing structure comprising a plurality of first members and a second member, wherein the plurality of first members are configured to constrain the second member, to increase a buckling load that the second member can accommodate, wherein the second member comprises a ductile and porous shape memory alloy (SMA), and wherein the plurality of first members comprise helical coils that are distributed about a periphery of the second member, such that the plurality of first members do not share a common central axis and are disposed externally of the second member.

11. The energy absorbing structure of claim 10, wherein the second member comprises a super elastic alloy that includes nickel and titanium.

12. An energy absorbing structure comprising:

(a) a porous shape memory alloy (SMA) member; and (b) a constraining member configured to selectively constrain the porous SMA member so as to increase a buckling load that the porous SMA member can accommodate, wherein the constraining member is configured to elastically deform under relatively smaller loads, and to constrain the porous SMA member under relatively larger loads, a positional relationship between the constraining member and the porous SMA member having been selected such that:

(i) a gap exists between the constraining member and the porous SMA member when the porous SMA member is unloaded, so that the porous SMA member is not in contact with the constraining member and is thus not constrained when the porous SMA member is unloaded; and (ii) no gap exists when the porous SMA member is experiencing a load sufficient to cause the porous SMA member to elastically deform to a degree sufficient to cause the porous SMA member to physically contact the constraining member, but insufficient to cause an irreversible deformation of the porous SMA member.

* * * * *

UNITED STATES PATENT AND TRADEMARK OFFICE

CERTIFICATE OF CORRECTION

PATENT NO. : 7,648,589 B2
APPLICATION NO. : 11/222023
DATED : January 19, 2010
INVENTOR(S) : Taya et al.

It is certified that error appears in the above-identified patent and that said Letters Patent is hereby corrected as shown below:

| | |
|---|---|
| Column 1, lines 13-15 | The paragraph under the heading "Government Rights" should be deleted and replaced in its entirety with the following: --This invention was made with government support under grant No. N-000140210666 awarded by the ONR. The Government has certain rights in the invention.-- |
| Column 4, line 6 | "rods" should read --rod-- |

Signed and Sealed this
Twenty-eighth Day of December, 2010

David J. Kappos

David J. Kappos
*Director of the United States Patent and Trademark Office*